US005368131A

United States Patent [19]

Yoshihiro

[11] Patent Number: 5,368,131

[45] Date of Patent: Nov. 29, 1994

[54] POWERLESS EMERGENCY ELEVATOR

[76] Inventor: Nishiyama Yoshihiro, 18-3, Kawagishi-cho, Suita-shi, Osaka-fu, Japan

[21] Appl. No.: 112,452

[22] Filed: Aug. 27, 1993

[30] Foreign Application Priority Data

Nov. 17, 1992 [JP] Japan ..... 4-332456

[51] Int. Cl.[5] ..... B66B 5/16

[52] U.S. Cl. ..... 187/301; 187/303

[58] Field of Search ..... 187/17, 71, 72, 73, 187/74, 80, 83, 92, 93, 94, 61

[56] References Cited

U.S. PATENT DOCUMENTS

| | | | |
|---|---|---|---|
| 470,960 | 3/1892 | Tracy | 187/92 |
| 606,489 | 6/1898 | Paroselli | 187/71 |
| 735,093 | 8/1903 | Greenwald | 187/94 |
| 837,961 | 12/1906 | Price | 187/80 X |
| 944,076 | 12/1909 | Dansey | 187/92 X |
| 953,297 | 3/1910 | Sautter | 187/61 X |
| 958,580 | 5/1910 | Baumer | 187/92 X |
| 1,107,191 | 8/1914 | Balliet | 187/94 |
| 3,200,905 | 8/1965 | Holderidge | 187/61 X |
| 3,332,516 | 7/1967 | Reinke | 187/61 |
| 4,650,036 | 3/1987 | Matsuda | 187/92 X |

*Primary Examiner*—Cheryl L. Gastineau
*Assistant Examiner*—Dean A. Reichard
*Attorney, Agent, or Firm*—Kanesake & Takeuchi

[57] ABSTRACT

A powerless emergency elevator includes guide rails (2) erected vertically; an elevator car (6) supported by a flexible rope (4) so as to be movable along the guide rails; a lock mechanism (7) provided on a top of the elevator car and biased in a locking direction for locking the elevator car to the guide rails; a power transmission path (9) extends upwardly from a floor plate (8) of the elevator car to the lock mechanism; a clutch mechanism (10) provided between the lock mechanism and the power transmission path for connecting or disconnecting the lock mechanism to the power transmission path; an auxiliary lock mechanism (11) provided on a side wall of the elevator car for releasing the clutch mechanism at evacuation and exit floors to thereby cut off the power transmission path; a handle (12) provided within the elevator car; a lock releasing mechanism (13) provided in the power transmission path for releasing the lock mechanism via the power transmission path by manipulating the handle; a lock releasing mechanism (15) interlocked to a door (14) of the elevator car and responsive to only a closing movement of the door to release the lock mechanism via the power transmission path; an engaging mechanism (16) responsive to opening and closing movements of the door and a weight of a passenger to connect or disconnect the interlocking mechanism via the power transmission path; and a lifting/speed control unit (17) for moving upwardly the elevator car via the flexible rope and controlling a descending speed of the elevator car.

2 Claims, 11 Drawing Sheets

POWERLESS EMERGENCY ELEVATOR

BACKGROUND OF THE INVENTION

1. Field of the Invention

The present invention relates to emergency elevators of the powerless type which needs no power based on electricity, heat, etc.

2. Description of the Related Art

The conventional methods for evacuating buildings in case of emergency include emergency elevators, chutes or mattresses, or escape ladders or fire engines.

For the emergency elevators it is generally necessary to supply electric power. At a time of emergency it is the common practice to switch to an auxiliary power supply such as a battery or a generator driven by an internal combustion engine.

However, there is still the possibility that the emergency elevator is cut off from the auxiliary power supply in case of emergency.

As for the chutes or mattresses, it is necessary to overcome fears. Also, it is impossible to evacuate many people at once.

With escape ladders or fire engines, it is not only very slow to evacuate many people but also impossible to do several people at once.

SUMMARY OF THE INVENTION

Accordingly, it is an object of the invention to provide a powerless emergency elevator which needs no power source but is able to evacuate many people at once.

According to the invention there is provided a powerless emergency elevator which includes guide rails erected vertically; an elevator car having an elevator housing supported by a flexible rope so as to be movable along the guide rails; a lock mechanism provided on a top of the elevator housing and biased in a locking direction for locking the elevator housing to the guide rails; a power transmission path extends upwardly from a floor plate of the elevator housing to the lock mechanism; a clutch mechanism provided between the lock mechanism and the power transmission path for connecting or disconnecting the lock mechanism to the power transmission path; an auxiliary lock mechanism provided on a side wall of the elevator car for releasing the clutch mechanism at evacuation and exit floors to thereby cut off the power transmission path; a handle provided within the elevator car; an interlocking mechanism provided in the power transmission path for releasing the lock mechanism via the power transmission path by manipulating the handle; a lock releasing mechanism interlocked to a door of the elevator housing and responsive to only a closing movement of the door to release the lock mechanism via the power transmission path; an engaging mechanism responsive to opening and closing movements of the door and a weight of a passenger to connect or disconnect the interlocking mechanism via the power transmission path; and a lifting/speed control unit for moving upwardly the elevator car via the flexible rope and controlling a descending speed of the elevator car.

In the powerless emergency elevator, the lifting/speed control means includes balance weights, the number of which increases as the elevator housing moves downwardly.

The elevator car is lifted to an evacuation floor by the lifting/speed control unit. The auxiliary lock mechanism actuates the clutch mechanism to cut off the power transmission path so that the lock mechanism is urged by the spring member in the locking direction to lock the elevator car to the guide rails.

When the elevator door is opened, the engaging mechanism engages to make the power transmission path from the floor plate to the lock mechanism. Then, when a passenger gets on, the clutch mechanism is released to cut off the power transmission path so that it is impossible to release the lock mechanism by manipulating the handle within the elevator car.

When the elevator door is closed, the engaging mechanism connects the clutch mechanism to make the power transmission path to the lock mechanism so that by manipulating the handle within the elevator car it is possible to release the lock mechanism via the interlocking mechanism and the power transmission path.

When the lock mechanism is released, the elevator car moves downwardly by the weight of the passenger. The descending speed is controlled within a predetermined range by the lifting/speed control unit connected to the flexible rope from which the elevator car is suspended.

When the elevator reaches the exit floor, the auxiliary lock mechanism releases the clutch mechanism to cut off the power transmission path. Since the elevator car is locked to the guide rails, the elevator car is not lifted when the passenger gets off.

When all of the passengers get off through the open door, the engaging mechanism engages and the power transmission path is connected. When the door is closed, the lock releasing mechanism releases the lock mechanism via the power transmission path.

The elevator car is lifted again to the evacuation floor by the lifting/speed control unit. The auxiliary lock mechanism locks the elevator car to the guide rails at the evacuation floor.

The above and other objects, features, and advantages of the present invention will be more apparent from the following description when taken in conjunction with the accompanying drawings.

DESCRIPTION OF THE PREFERRED EMBODIMENT

Figure 1:
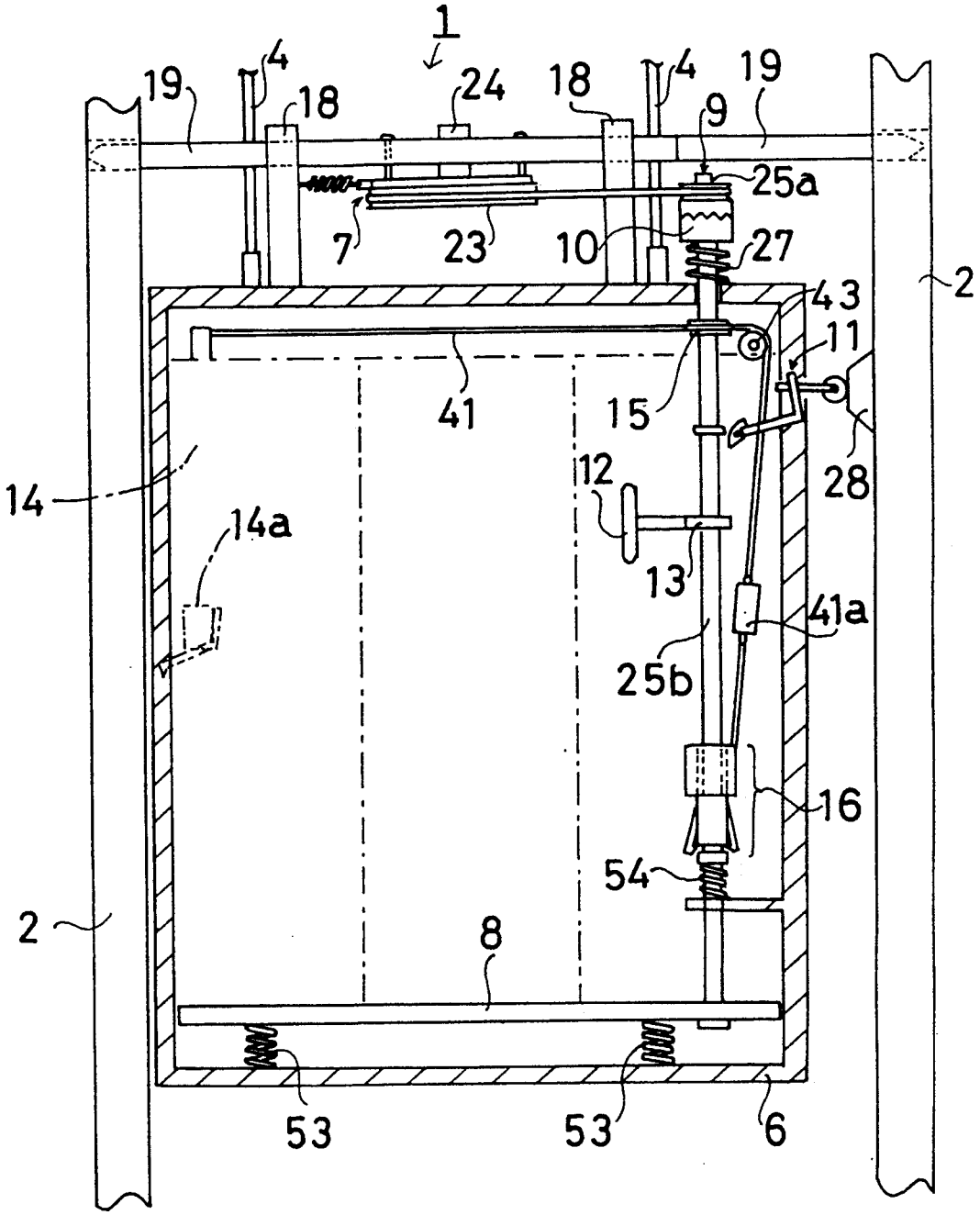
FIG. 1 is a partially sectional, front elevational view of a powerless emergency elevator according to an embodiment of the invention.
Figure 5:
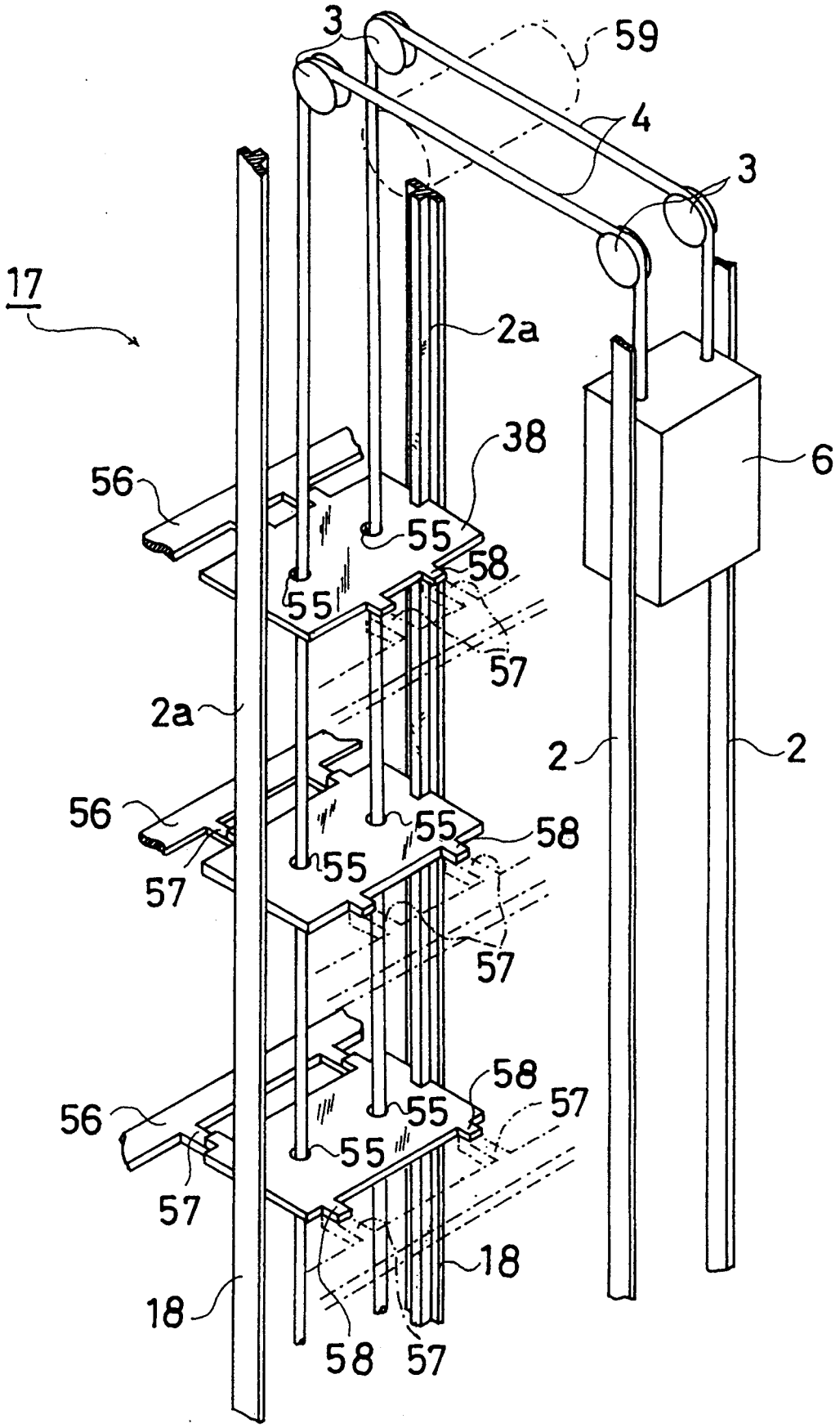
FIG. 5 is a perspective view of a lifting/speed control unit according to an embodiment of the invention.

In FIGS. 1 and 5, a powerless emergency elevator 1 includes an elevator car 6 which is guided by guide rails 2 and supported by flexible rope 4 via pulleys 3; a lock mechanism 7 which is biased in the locking direction to lock the elevator car 6 to the guide rails 2; a power transmission path 9 which extends upwardly from a floor plate 8 to the lock mechanism 7; a clutch mechanism 10 for connecting/disconnecting the power transmission path 9 to the lock mechanism 7; an auxiliary lock mechanism 11 for releasing the clutch mechanism 10 to cut off the power transmission path 9 at evacuation and exit floors; an interlocking mechanism 13 for releasing the lock mechanism 7 via the power transmission path 9 by operating a handle 12 provided within the elevator car 6; a lock release mechanism 15 interlocked with an elevator door 14 in the closing direction to release the lock mechanism 7 via the power transmission path 9; an engaging mechanism 16 for engaging or disengaging the clutch mechanism 10 via the power transmission path 9 in response to the movement of the elevator door 14 and the weight of a passenger 5 within the elevator; and a lifting/speed control unit 17 connected to the elevator car with the flexible ropes 4 via the pulleys 3 for elevating the elevator car 6 and controlling its descending speed.

Figure 2:
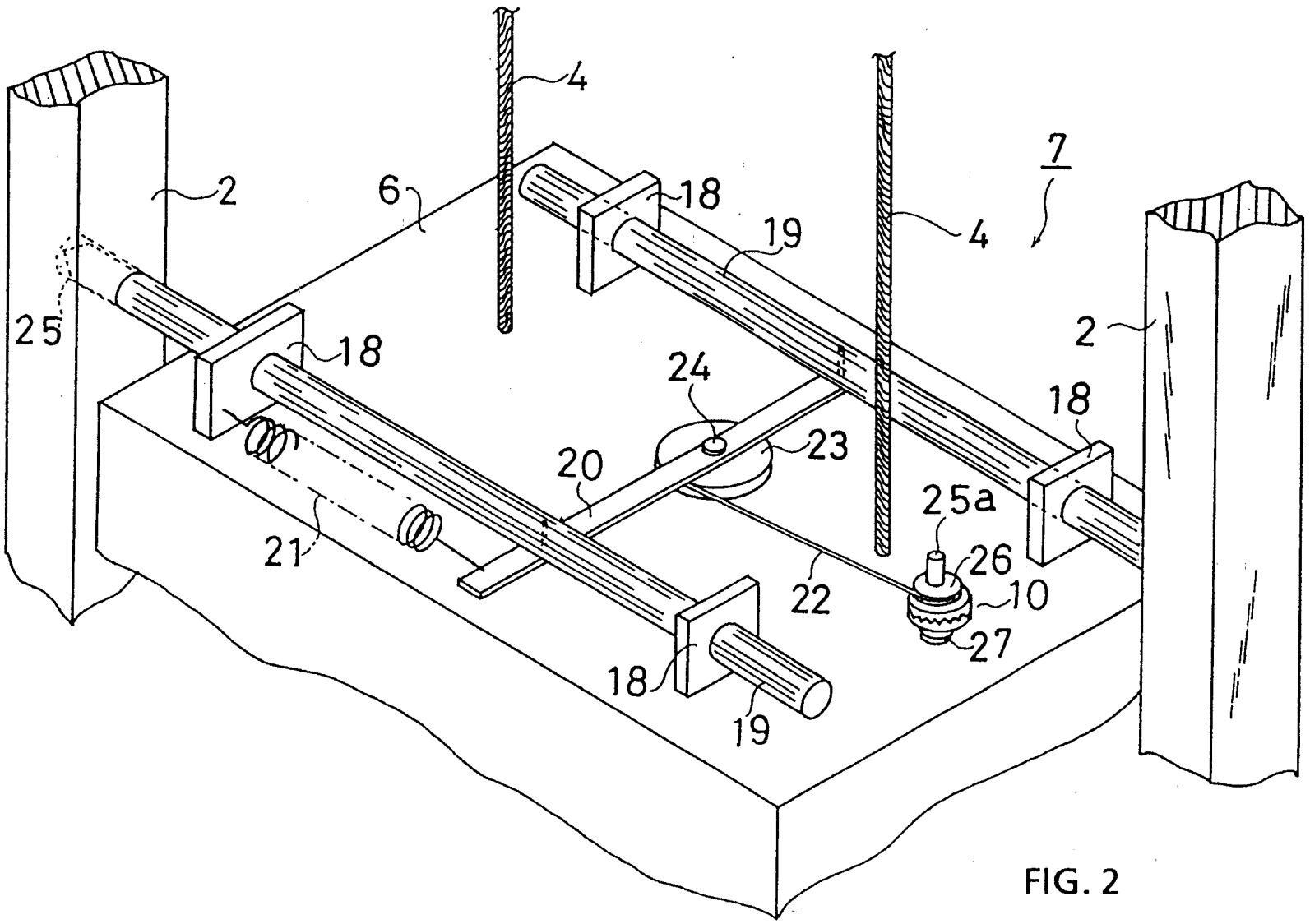
FIG. 2 is a perspective view of a lock mechanism for the powerless emergency elevator.

In FIG. 2, the lock mechanism 7 is made up of a pair of lock bars 19 supported for sliding movement by retention members 18 mounted to the ceiling of the elevator car 6; a movable linkage 20 pivoted to the middle points of the lock bars 19; a coil spring 21 placed between one of the retention members 18 and one end of the movable linkage 20; and a connecting shaft 24 attached to the center of the movable linkage 20 and provided with at its lower end a pulley 23 around which a flexible line 22 is wound. The elevator car 6 is locked to the guide rails 2 by fitting lock bars 19 into lock holes 25 provided in the guide rails 2 at an evacuation or exit floor. The evacuation floor is an emergency floor from which passengers are evacuated. The exit floor is a safe floor into which passengers move and through which passengers escape from the building.

The lock bars 19 are moved in opposite directions by turning the movable linkage 20 about the connection shaft 24. The lock bars 19 are biased in the locking direction by the coil spring 21, and the lock is released when the movable linkage 20 is turned by the flexible line 22 in the lock releasing direction.

The flexible line 22 is wound around a pulley 26 attached to a top shaft 25*a* of the power transmission path 9. The pulley 26 is turned against the bias of the coil spring 21 for releasing the lock.

The clutch mechanism 10 connects or disconnects the shafts 25*a* and 25*b* of the power transmission path 9. The middle shaft 25*b* is biased by a coil spring 27 in the connecting direction so that the clutch mechanism 10 remains in connecting condition unless a downward force is applied.

The guide rails 2 are provided with trapezoidal projections 28 for activating the auxiliary lock mechanism 11 for locking the elevator car 6 to the guide rails 2 when the elevator car 6 is located at an evacuation or exit floor.

Figure 3:
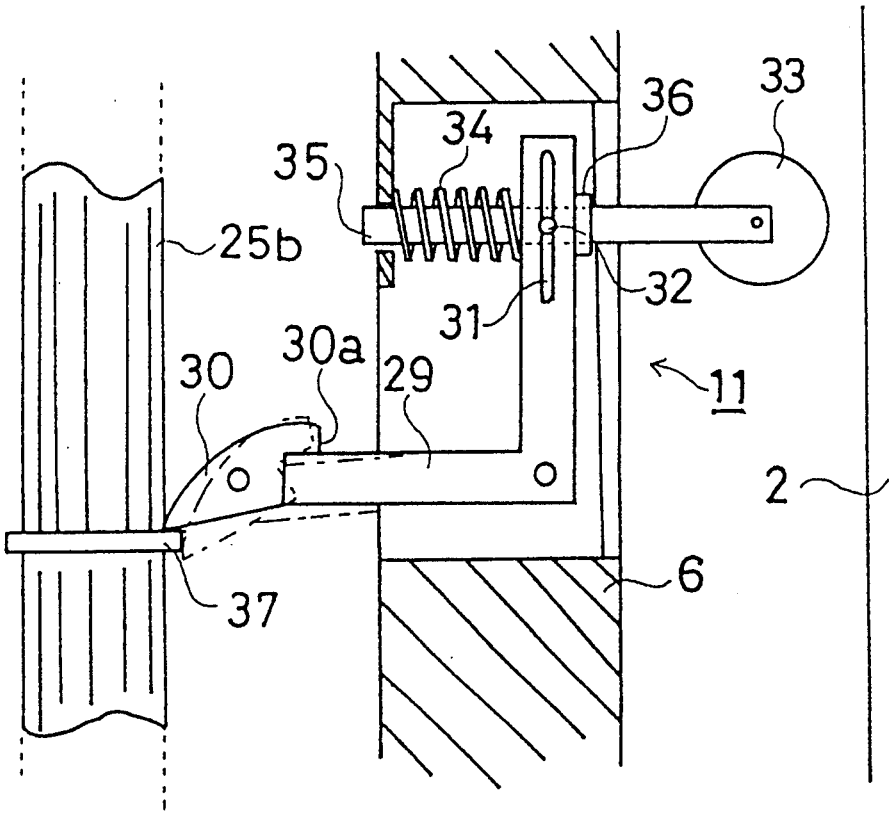
FIG. 3 is a partially sectional, front elevational view of an auxiliary lock mechanism at rest for the powerless emergency elevator.
Figure 4:
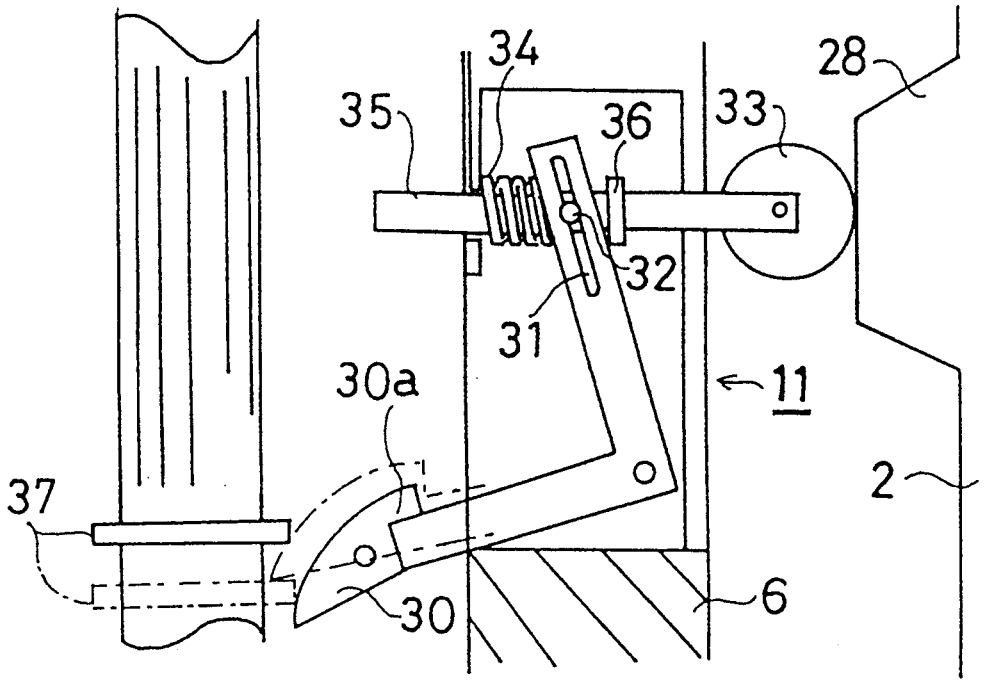
FIG. 4 is a partially sectional, front elevational view of the auxiliary lock mechanism in action.

In FIGS. 3 and 4, the auxiliary lock mechanism 11 is made up of an L-shaped member 29 pivoted to a cavity provided in a side wall of the elevator car 6; a claw 30 pivoted to one end of the L-shaped member 29 for disconnecting the transmission path 9; and a rod member 35 provided with a roller 33 for detecting a projection 28 on the guide rail 2 and a fixed pin 32 for sliding within a slot 31 of the L-shaped member 29, the rod member 35 being biased in clockwise direction by a spring member 34 and stopped by a stopper member 36.

The claw 30 is pivoted to one end of the L-shaped member 29 which is biased in clockwise direction by a coil spring 34. Also, it is provided with an abutting shoulder 30*a* so that it cannot be turned upwardly beyond an angle determined by the abutting shoulder 30*a*.

The spring member 34 is placed between the car wall and the L-shaped member 29 so that it is biased in clockwise direction.

Where the roller 33 is not on the projection 28 of the guide rail 2 as shown in FIG. 3, the coil spring 34 urges the L-shaped member 29 so that the engaging claw 30 passes over a ring member 37 disposed at a predetermined position of the shaft 25*b* and rests at the top surface of the ring member 37 so that the clutch mechanism 10 is connected to make the power transmission path 9.

In FIG. 4, when the roller 33 climbs the slope of the projection 28 of the guide rail 2, the fixed pin 32 is moved within the slot 31 to turn the L-shaped member 29 so that the engaging claw 30 pushes downwardly the ring member 37 as shown in broken line to disconnect the clutch mechanism 10. When the roller 33 reaches the top of the projection 28, the engaging claw 30 disengages the ring member 37 as shown in solid line.

The auxiliary lock mechanism 11 temporarily disconnects the clutch mechanism 10 at the evacuation floor and the exit floor to thereby cut off the power transmission path 9. Consequently, the lock mechanism 7 is able to lock the elevator car 6 to the guide rail 2 so that passengers can get on or off safely.

In FIG. 5, the elevator car 6 is supported by the flexible rope 4 to which balance weights 38 are related via the pulleys 3. The elevator car 6 is moved downwardly by the weight of passengers 5 against the gravitational pull of the balance weights 38. Preferably, a hydraulic shock absorber or the like is provided to reduce the impact to the elevator car 6 at the evacuation and exit floors.

Figure 6:
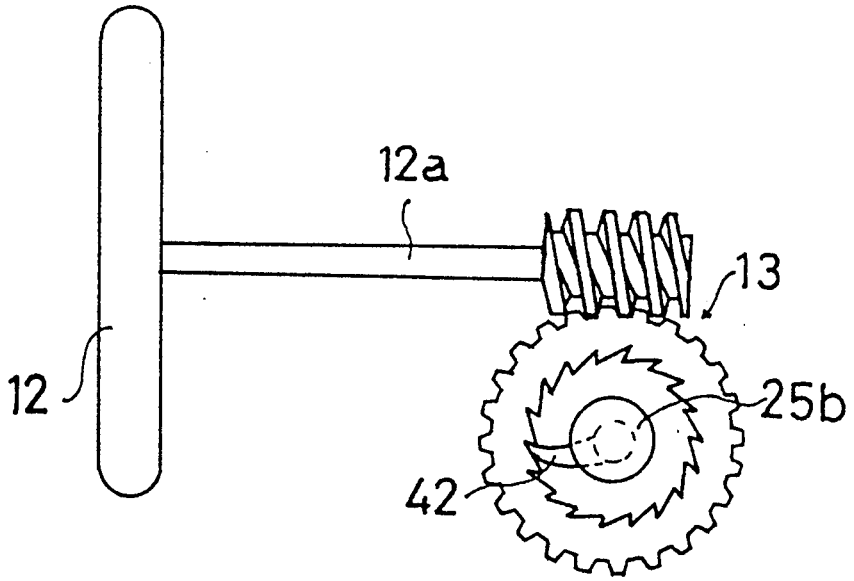
FIG. 6 is a top plan view of a handle member and an interlocking mechanism for the powerless emergency elevator.

In FIG. 6, the interlock mechanism 13 includes a ratchet mechanism having a prong 42 secured to the shaft 25*b* for permitting the shaft 25*b* to turn only in the lock releasing direction and a worm gear with which it is connected to the handle 12 within the elevator car 6.

The handle 12 has a fixed bar 12*a* with the worm gear in mesh with the interlocking mechanism 13. Where the clutch mechanism 10 is connected, it is possible to wind the flexible line 22 for releasing the lock by turning the handle 12 to thereby turn the middle shaft 25*b*.

Figure 7:
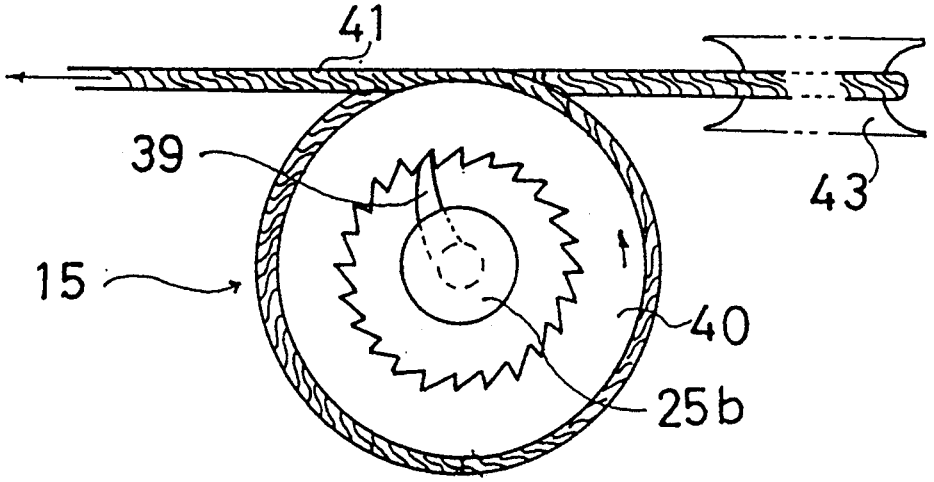
FIG. 7 is a top plan view of a lock release mechanism for the powerless emergency elevator.

In FIGS. 1 and 7, the lock release mechanism 15 has a ratchet mechanism having a pulley 40 which allows the shaft 25*b* to turn only in the lock releasing direction (shown by an arrow) when the clutch mechanism 10 is connected. A flexible member 41 is put around the pulley 40 and connected to the upper corner of the elevator door 14 and the engaging mechanism 16 via a pulley 43.

In interlocking with the elevator door 14, the middle shaft 25*b* is turned in the predetermined direction by the rachet mechanism of the pulley 40. When the clutch mechanism 10 is connected, the flexible line 22 is wound around the pulley 26 to release the lock mechanism 7.

Figure 8:
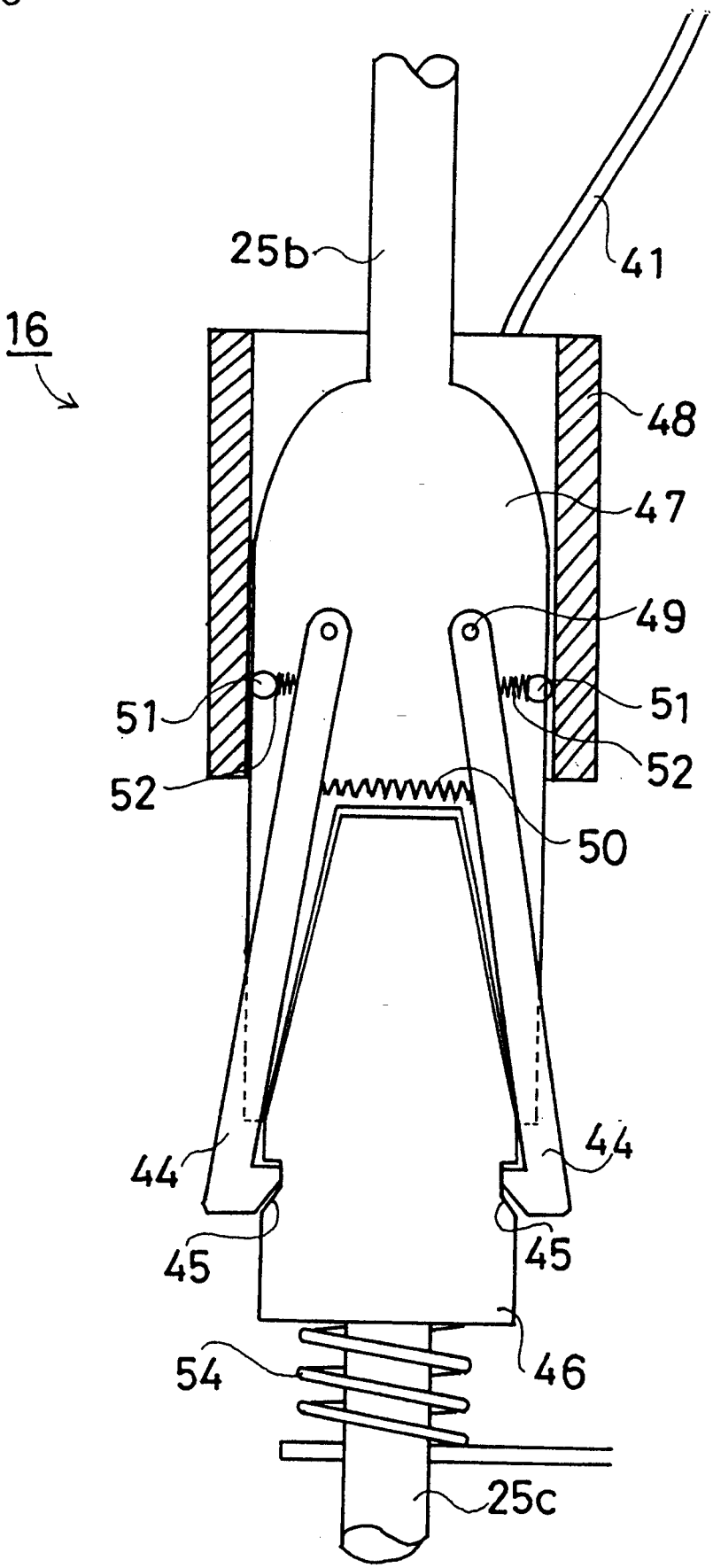
FIG. 8 is a partially sectional, front elevational view of an engaging mechanism for the powerless emergency elevator.

In FIGS. 1 and 8, the engaging mechanism 16 includes an engageable member 46 secured to the top of a bottom shaft 25*c*, which is secured to the floor plate 8, and having a circumferential groove 45 for receiving the tips of the engaging fingers 44; an engaging member 47 secured to the lower end of the middle shaft 25*b* and having a substantially conical cavity which fits over the engageable member 46 and the engaging fingers 44 which engage the circumferential groove 45; and a cylindrical member 48 which is connected to the flexible member 41 and fits over the engaging member 47. Preferably, a weight 41*a* or the like is attached to the flexible member 41 between the pulley 43 and the cylindrical member 48 in order to prevent sag of the flexible member 41 when the door 14 is opened.

As the door 14 is closed, the flexible member 41 pulls up the cylindrical member 48 from the engaging fingers 44 while as the door 14 is opened, since the cylindrical member 48 is fitted over the engaging fingers 44.

The engaging fingers 44 are pivoted at 49 to the engaging member 47 and biased outwardly by a coil spring 50 which is placed between the engaging fingers 44. The engaging fingers 44 are provided with a coil spring 52 having a ball 51 at a free end so that when the cylindrical member 48 presses the balls 51, the engaging fingers 44 are biased inwardly.

The engaging fingers 44 engage the circumferential groove 45 but are slidable in circumferential direction so that the shaft 25*b* is permitted to rotate under engaging conditions.

When a passenger enters the elevator car 6 with the engaging member 47 engaging the engageable member 46, the floor plate 8 is pushed downwardly by the weight of the passenger 5 so that the shaft 25*c* is pulled downwardly which in turn pulls downwardly the shaft 25*b* to thereby disconnect the clutch. Conversely, when the door is closed, and the flexible member 41 pulls up the cylindrical member 48 to release the engaging fingers 44, the engaging member 47 is urged upwardly by the coil spring 27 via the shaft 25*b* so that the engaging mechanism 16 is released and the clutch mechanism 10 is connected.

Figure 9:
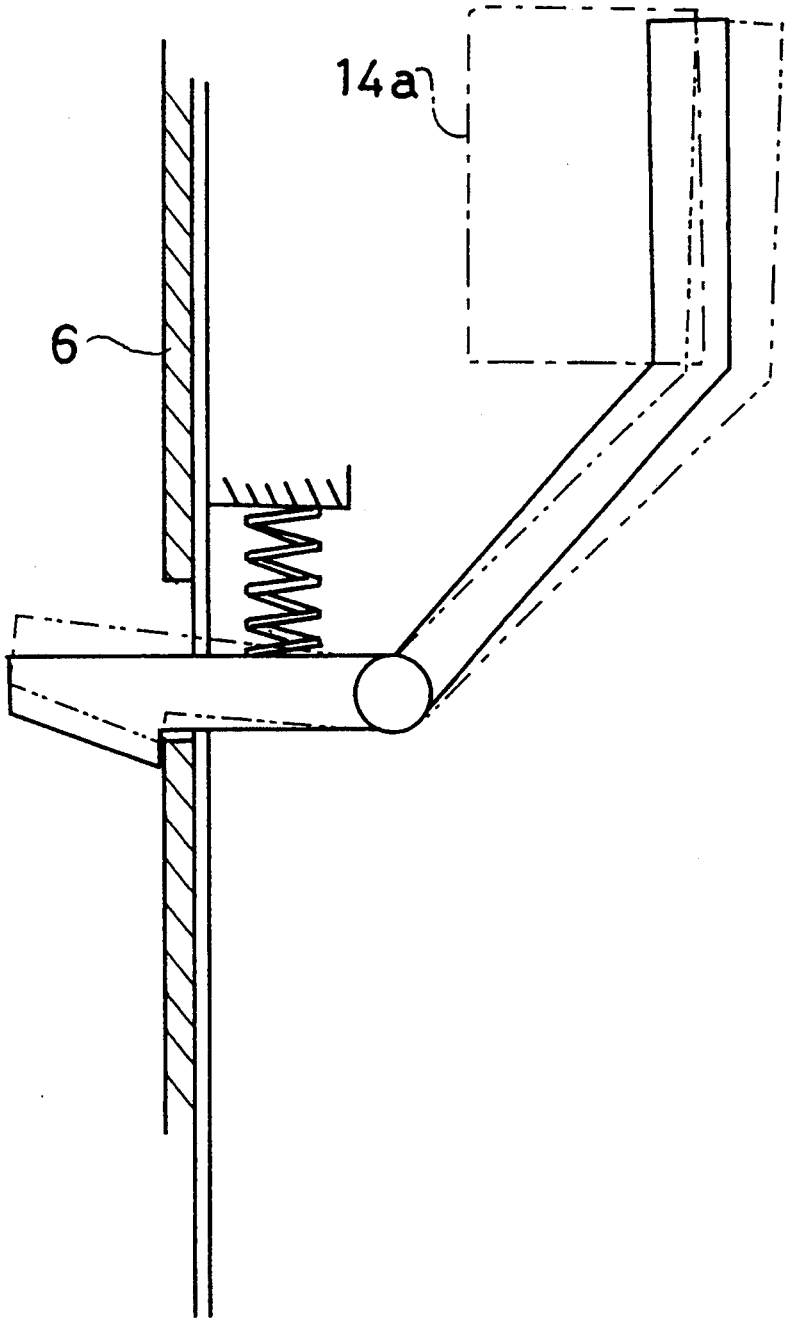
FIG. 9 is a front elevational view of an automatic door lock for the powerless emergency elevator.

In FIG. 9, preferably, an automatic lock is provided on a handle 14*a* of the door 14 for automatically locking the door when it is closed and releasing the lock when the handle 14*a* is pressed.

Where no passenger is in the elevator, the coil springs 53 placed between the elevator car 6 and the floor plate 8 pushes upwardly the floor plate 8, and the coil springs 27 and 54 bias upwardly the shafts 25*c* and 25*b* to connect the clutch mechanism 10 for making the power transmission path 9.

In FIG. 5, the balance weights 38 have a pair of recesses on opposite sides for receiving the leg portions of T-shaped guide rails 2*a*, a pair of apertures 55 through which the flexible ropes 4 pass, and pairs of projections 58 which are supported by support members 57 extending from frames 56 which are fixed at predetermined intervals along the guide rails 2*a*. Preferably, spring members, such as coil springs, are provided on the support members 57 to reduce the impacts when the balance weight 38 hits.

As the elevator car 6 moves downwardly from the emergency floor, the lowest balance weight 38 moves upwardly and picks up upper balance weights 38 which are disposed at predetermined intervals along the guide rails 2*a* to thereby control the descending speed of the elevator car 6. As the elevator car 6 moves upwardly from the exiting floor, the balance weights 38 are disposed again at the predetermined intervals along the guide rails 2*a* to thereby control the ascending speed of the elevator car 6.

Figure 10:
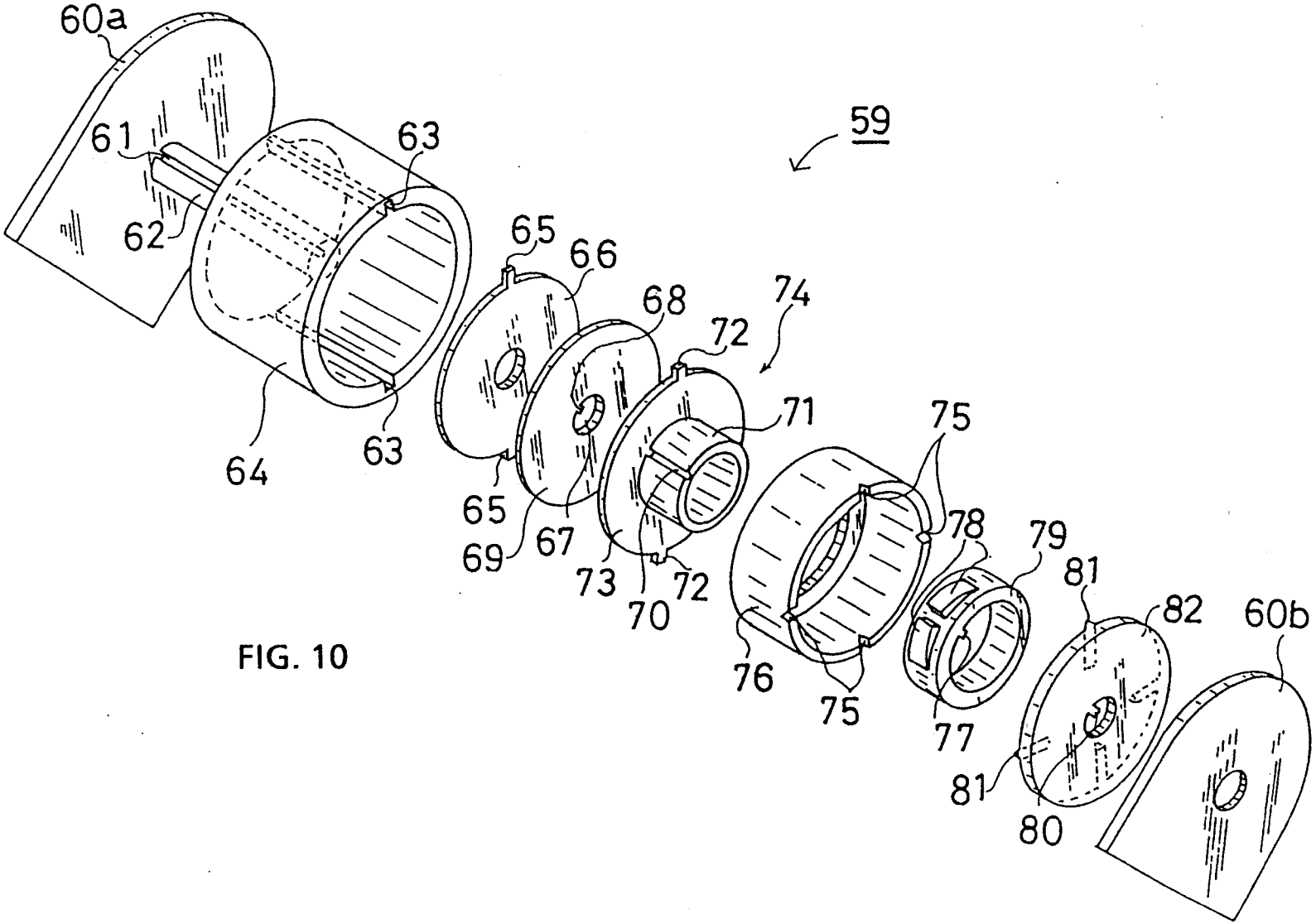
FIG. 10 is an exploded perspective view of a speed governor for the powerless emergency elevator.

In FIG. 10, in addition to the balance weights 38, a speed governor 59 which makes use of centrifugal forces is provided. This speed governor 59 includes a shaft 62 secured to bearings 60*a* and 60*b* and having a key channel 61; a cylindrical drum 64 rotatable about the shaft 62 to wind the flexible rope 4 and having fitting grooves 63 on the inside wall; a friction plate 66 in the form of a disk and fitted over the shaft 62 and having projections 65 extending outwardly from the peripheral edge and able to fit into the fitting grooves 63; a lining member 69 in the form of a disk able to fit into the cylindrical drum 64 and having a key 68 extending inwardly from the edge of a fitting hole 67 through which the shaft 62 passes; a pressure vessel 74 having a cylindrical section 71 through which the shaft 62 passes and which has a key groove 70 on the outer surface and a flange section 73 having projections 72 extending outwardly from the peripheral edge to fit into the fitting grooves 63; a movable regulator 76 in the form of a cylinder able to fit into the cylindrical drum 64 and having a fitting hole on the bottom for fitting over the cylindrical section 71 of the pressure vessel 74 and notches 75 provided on the edge opposite to the bottom; a rotor 79 in the form of a cylinder loosely fitted into the movable regulator 76 and having on the inside surface wall a key 77 able to fit into the key groove 70 and flaps 78 on the outside surface; and a regulator retention plate 82 having a key 80 adapted to fit into the key groove 61 and radial ridges 81 adapted to fit into the notches 75.

The speed governor 59 is disposed at a position between the elevator car 6 and the lifting/speed control unit 17 as shown by broken line in FIG. 5. The flexible rope 4 for pulling upwardly the elevator car 6 is wound around the drum 64. When the flexible rope 4 and the drum 64 are at rest, the radial ridges 81 of the regulator retention plate 82 fit into the notches 75 of the movable regulator 76. As the flexible rope 4 moves, the drum 64 turns. As the angular velocity of the drum 64 increases, the angular velocity of the rotor 79 increases so that the centrifugal forces on the flaps 78 of the rotor 79 increase. Consequently, the flaps 78 swing outwardly making frictional contact with the movable regulator 76 which turns the movable regulator 76. As a result, the notches 75 disengage the radial ridges 81 of the regulator retention plate 82 to push the pressure vessel 74 toward the bearing 60*a*. This pushes the lining 69 and the friction plate 66 toward the bearing 60*a*, producing friction between the friction plate 66 and the bearing 60*a*, thereby controlling the rotation of the drum 64.

Figure 11:
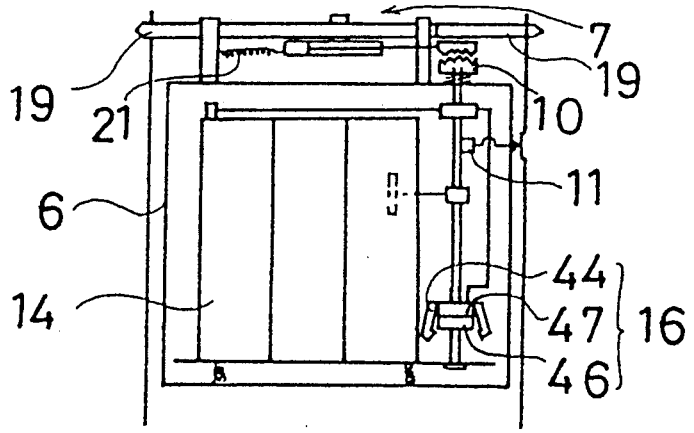
FIG. 11 is a front elevational view of the powerless emergency elevator which is locked to guide rails at an evacuation floor.

In FIG. 11, when the elevator car 6 rests at the emergency floor, the auxiliary lock mechanism 11 disconnects the clutch mechanism 10 to thereby cut off the power transmission path 9. Consequently, the coil spring 21 urges the lock bar 19 toward the lock position to thereby lock the elevator car 6 to the guide rails 2.

As shown in FIG. 8, when the door 14 is closed, the cylindrical member 48 is pulled upwardly by the flexible member 41 to thereby release the pressure to the balls 51. Consequently, the coil spring 50 urges the engaging fingers 44 outwardly so that they do not engage the circumferential groove 45 while the coil springs 53 push upwardly the floor plate 8 so that the engageable member 46 fits into the engaging member 47.

Figure 12:
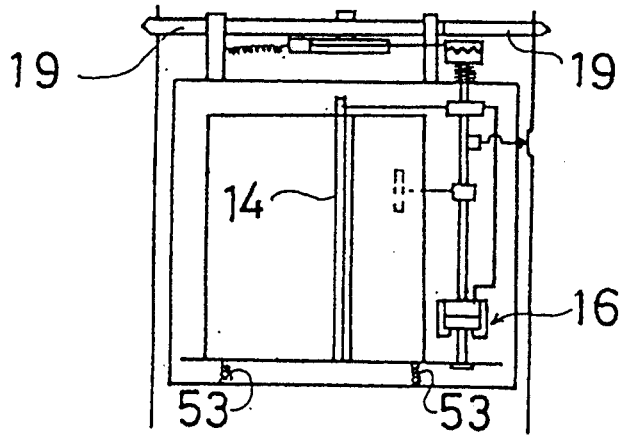
FIG. 12 is a front elevational view of the powerless emergency elevator whose door is open.

In FIG. 12, when the door 14 is opened, the cylindrical member 48 fits over the engaging member 47 to press the balls 51 so that the engaging fingers 44 engage the circumferential groove 45. Thus, the engaging mechanism 16 is connected.

Figure 13:
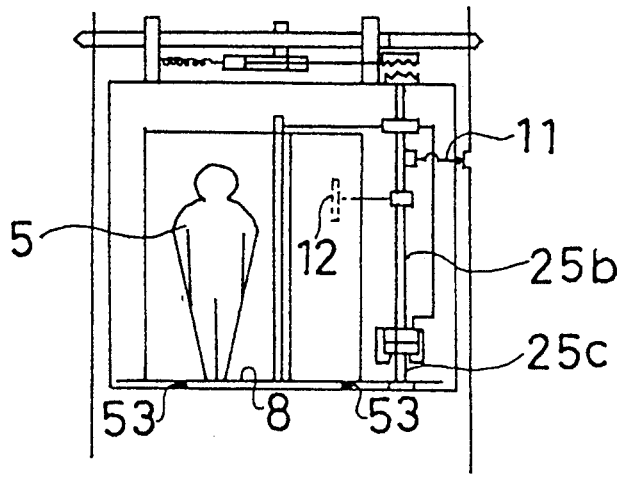
FIG. 13 is a front elevational view of the powerless emergency elevator having a passenger.

In FIG. 13, when a passenger 5 gets on, the weight of the passenger 5 pushes downwardly the floor plate 8 against the coil spring 53, which pulls downwardly the shafts 25*c* and 25*b* of the power transmission path 9. Since the clutch mechanism 10 is released, it is impossible to release the lock mechanism 7 by manipulate the handle 12 within the elevator car 6.

Figure 14:
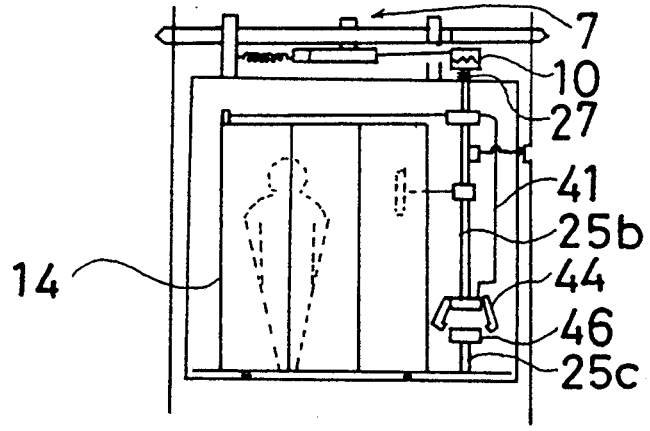
FIG. 14 is a front elevational view of the powerless emergency elevator whose door is closed with the passenger inside.

In FIGS. 8 and 14, when the passenger 5 closes the door 14, the flexible member 41 pulls up the cylindrical member 48 from the engaging mechanism 16 so that the engaging fingers 44 disengage the circumferential groove 45 of the engageable member 46. Consequently, the shafts 25*c* and 25*b* are disconnected so that the shaft 25*b* is urged upwardly by the coil spring 27 to connect the clutch mechanism 10 for making the power transmission path 9.

Figure 15:
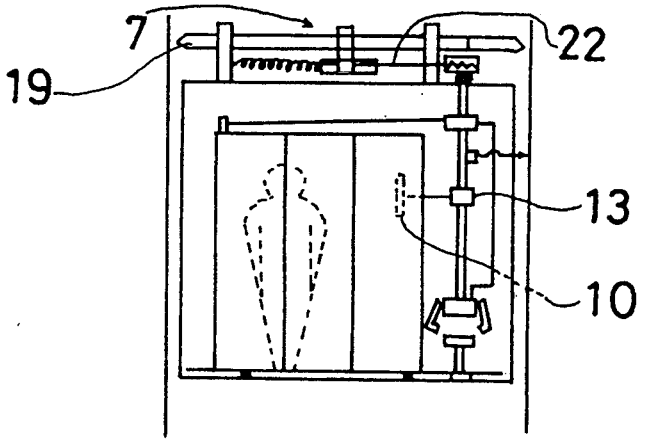
FIG. 15 is a front elevational view of the powerless emergency elevator which is unlocked by operating the handle within the elevator.

In FIGS. 2 and 15, by manipulating the handle 12 within the elevator car 6, it is possible to turn the pulley 26 in the lock releasing direction via the interlocking mechanism 13 to thereby wind the flexible rope 22 around the pulley 26, which turns the rotatable linkage 20 to thereby remove the lock bars 19 from the lock holes 25 of the guide rails 2. When the lock mechanism 7 is released, the elevator car 6 moves down by the weight of the passenger 5.

Figure 16:
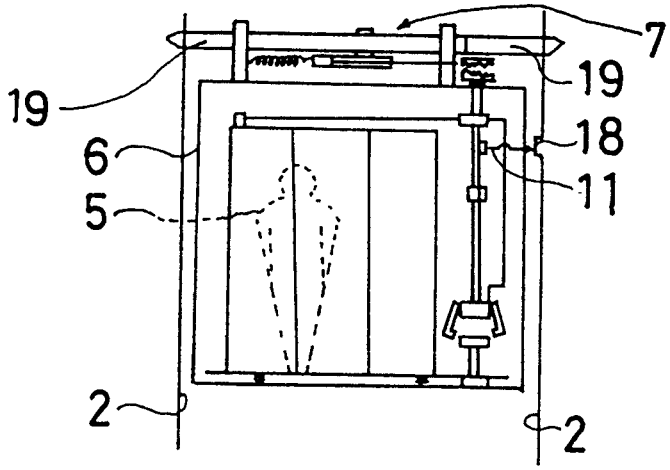
FIG. 16 is a front elevational view of the powerless emergency elevator which has reached and is locked at an exit floor by the auxiliary lock mechanism.

In FIG. 16, when the elevator car 6 reaches the exit floor, the roller 33 of the auxiliary lock mechanism 11 is located on the projection 28 of the guide rail 2 to thereby disconnect the clutch mechanism 10. Consequently, the power transmission path 9 is cut off so that the lock bars 19 are urged in the locking direction by the coil spring 21 via the rotatable linkage 20 into the lock holes 25 of the guide rails 2.

Figure 17:
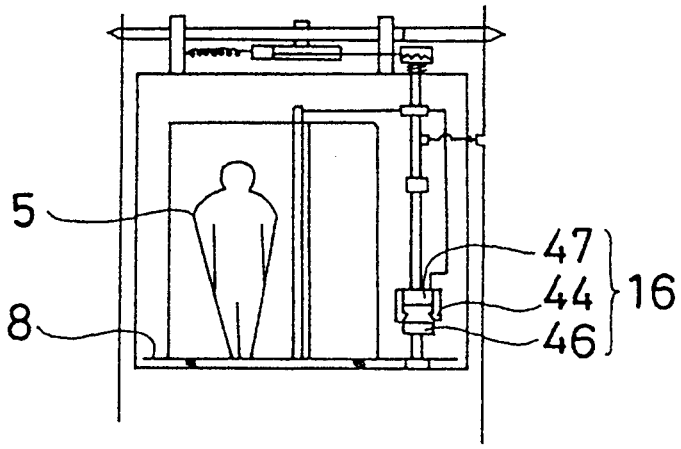
FIG. 17 is a front elevational view of the powerless emergency elevator whose door is opened at the exit floor.

In FIGS. 8 and 17, when the door 14 is opened at the exit floor, the cylindrical member 48 of the engaging mechanism 16 fits over the engaging member 47 so as to urge the engaging fingers 44 to engage the circumferential groove 45. However, the weight of the passenger 5 pushes downwardly the floor plate 8 so that the engageable member 46 is out of reach of the engaging fingers 44, keeping the engaging mechanism 16 disconnected.

Figure 18:
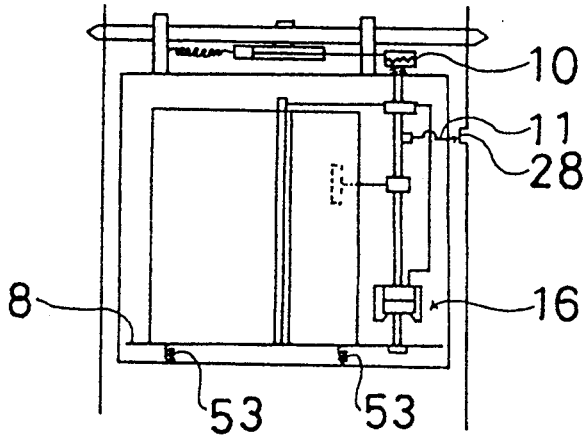
FIG. 18 is a front elevational view of the powerless emergency elevator from which the passenger has got out.

In FIG. 18, when the passenger 5 gets off, the floor plate 8 is urged upwardly by the coil springs 53, bringing upwardly the shaft 25*c* so that the cylindrical member 47 fits over the engageable member 46 and the engaging fingers 44 engage the circumferential groove 45.

Figure 19:
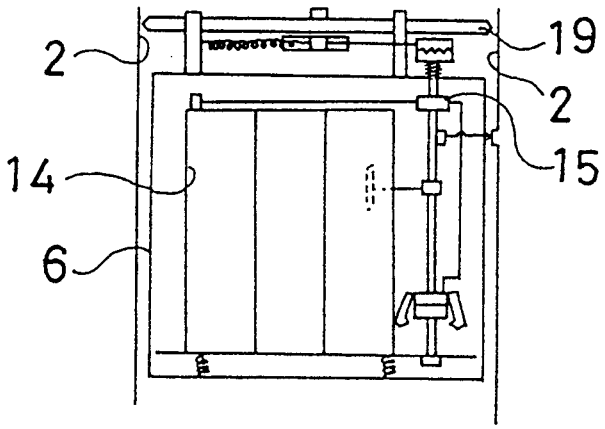
FIG. 19 is a front elevational view of the powerless emergency elevator whose door is closed from outside.

In FIG. 19, by closing the door 14 it is possible to actuate the lock mechanism 15 to remove the lock bars 19 from the guide rails 2 so that the balance weight 38 moves upwardly the elevator car 6 and lock the elevator car 6 at the evacuation floor.

As described above, with the powerless emergency elevator according to the invention it is possible to evacuate passengers from an upper floor to a lower floor without using electricity, heat, or other type of energy.

In addition, it is possible to control the descending speed of the powerless emergency elevator within a predetermined range.

I claim:

1. A powerless emergency elevator, comprising:

guide rails erected vertically;

an elevator car having an elevator housing supported by a flexible rope so as to be movable along said guide rails;

a lock mechanism provided on a top of said elevator housing and biased in a locking direction for locking said elevator housing to said guide rails;

a power transmission path extending upwardly from a floor plate of said elevator housing to said lock mechanism;

a clutch mechanism provided between said lock mechanism and said power transmission path for connecting or disconnecting said lock mechanism to said power transmission path;

an auxiliary lock mechanism provided on a side wall of said elevator car for releasing said clutch mechanism at evacuation and exit floors to thereby cut off said power transmission path;

a handle provided within said elevator car;

an interlocking mechanism provided in said power transmission path for releasing said lock mechanism via said power transmission path by manipulating said handle;

a lock releasing mechanism interlocked to a door of said elevator housing and responsive to only a closing movement of said door to release said lock mechanism via said power transmission path;

an engaging mechanism responsive to opening and closing movements of said door and a weight of a passenger to connect or disconnect said interlocking mechanism via said power transmission path; and lifting/speed control means for moving upwardly said elevator car via said flexible rope and controlling a descending speed of said elevator car.

2. The powerless emergency elevator of claim 1, wherein said lifting/speed control means comprises balance weights, the number of which increases as said elevator housing moves downwardly.

* * * * *